United States Patent [19]

Shu

[11] Patent Number: 4,856,296

[45] Date of Patent: Aug. 15, 1989

[54] CLOSED VARIABLE-VOLUME CONTAINER COOLABLE TO RAPIDLY SOLIDIFY WATER THEREIN

[75] Inventor: Chi-Yao Shu, Tainan, Taiwan

[73] Assignees: Matthias Tai, Hsin-Chu; Shing-Bun Hu, Taipei; Gwo-Guer Yeh, Kaohsiung; Mow-Ho Guo, Hsinchu, all of Taiwan

[21] Appl. No.: 217,827

[22] Filed: Jul. 12, 1988

[51] Int. Cl.[4] ..... F25D 11/00

[52] U.S. Cl. ..... 62/430; 62/59; 62/438; 62/530

[58] Field of Search ..... 62/59, 293, 260, 430, 62/530, 438

[56] References Cited

U.S. PATENT DOCUMENTS

| | | | |
|---|---|---|---|
| 2,007,288 | 7/1935 | Thomson | 62/59 X |
| 2,538,015 | 1/1951 | Kleist | 62/59 X |
| 3,271,968 | 9/1966 | Karnath | 62/59 |
| 3,672,183 | 6/1972 | Bernstein | 62/59 X |
| 3,943,722 | 3/1976 | Ross | 62/260 X |
| 4,690,205 | 9/1987 | Jelbring | 62/260 X |
| 4,761,314 | 8/1988 | Marshall | 62/29.3 X |

*Primary Examiner*—Lloyd L. King

*Attorney, Agent, or Firm*—Birch, Stewart, Kolasch & Birch

[57] ABSTRACT

A container includes a closed variable-volume container body, and a central stem secured in the container body. The central stem generally extends along the axis of the container body and has a plurality of branches generally extending radially outwardly from its full length. When the container body is filled with water and cooled, the central stem serves as a core on which ice deposits so that the temperature at which the water begins to solidify is raised.

12 Claims, 3 Drawing Sheets

CLOSED VARIABLE-VOLUME CONTAINER COOLABLE TO RAPIDLY SOLIDIFY WATER THEREIN

BACKGROUND OF THE INVENTION

This invention relates to a container for water or ice in an ice bunker of an air cooling system, and more particularly to a closed variable-volume container which can be cooled to rapidly solidify water therein.

Water circulated and cooled over ice offers an economical means for space cooling. Cold-water is pumped from an ice bunker through an extended-surface coil. In the coil, the water absorbs heat from the air, which is blown across the coil. The warmed water than returns to the bunker, where its temperature is again reduced by the latent heat of fusion. Generally, a plurality of water-ice containers are housed within an ice bunker. When the containers are cooled to 7° C., the water begins to solidify radially inwardly in the containers. Then, the external cooling temperature can be raised to 4° C. at which temperature the water in the containers will continue to solidify. Because it is difficult for the outer layer of ice to conduct heat, in this icing process the external cooling temperature must be again lowered to 6.5° C. so that the water in the containers can totally solidify. Using this rather low cooling temperature is time-consuming and power-consuming, resulting in high operating costs. When the water solidifies, its volume is enlarged. Whether the containers are filled with water or not, the solidification of the water in the containers will largely increase the pressure in the containers. Because conventional water-ice containers are of a fixed volume, they are easily damaged or deformed by repeated phase changes between water and ice.

SUMMARY OF THE INVENTION

It is therefore the main object of this invention to provide a water-ice container with a central stem provided therein whereby the water can also solidify radially outwardly from the center of the container.

Another object of this invention is to provide a closed variable-volume water-ice container.

According to this invention, a container includes a closed variable-volume container body, and a central stem secured in the container body. The central stem generally extends along the axis of the container body and has a plurality of branches generally extending radially outwardly from its full length. When the container body is filled with water and cooled, the central stem serves as a core on which ice deposits so that the temperature at which the water begins to solidify is raised.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of this invention will become apparent in the following detailed description of a preferred embodiment of this invention with reference to the accompanying drawings which are given by way of illustration only, and thus are not limitative of the present invention, and in which.

DETAILED DESCRIPTION OF THE PREFERRED EMBODIMENT

Figure 1:
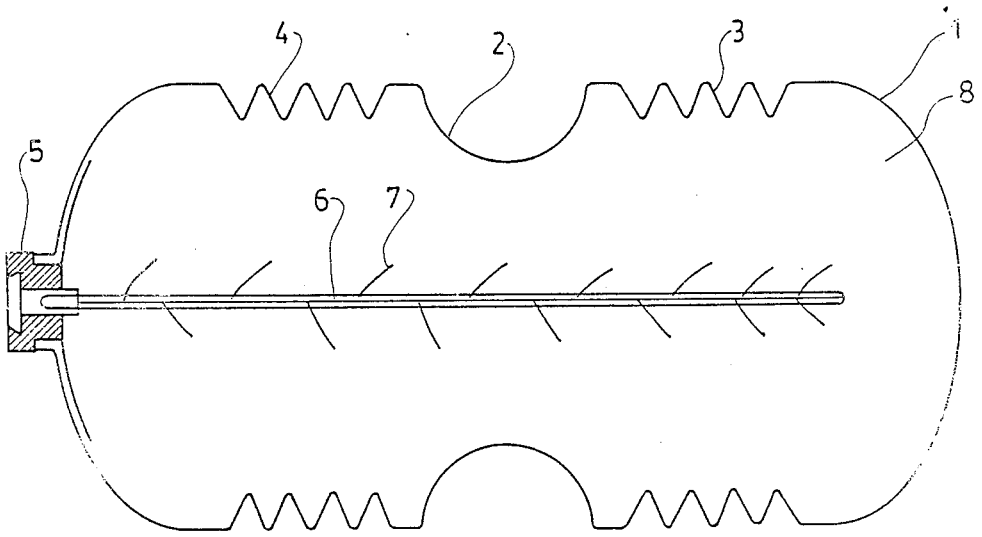
FIG. 1 shows the structure of a water-ice container according to this invention.

Referring to FIG. 1, a water-ice container of this invention includes an elongated plastic container body 1. The container body 1 has an annular groove 2 formed in its middle portion, two bellows-like portions 3 and 4 located on the opposite sides of the groove 2, and an opening formed at an end of the container body 1. A plug 5 seals the opening of the container body 1 and is sleeved rigidly on a metal central stem 6 which has good heat conductivity. The central stem 6 extends from the plug 5 to a position adjacent to the closed end of the container body 1 and has a plurality of branches 7 which generally extend radially outwardly from its full length in a brush-like manner. The interior 8 of the container body 1 is filled with water. The plug 5 is welded to the container body 1 so as to prevent the disengagement of the plug 5 from the container body 1.

Figure 2:
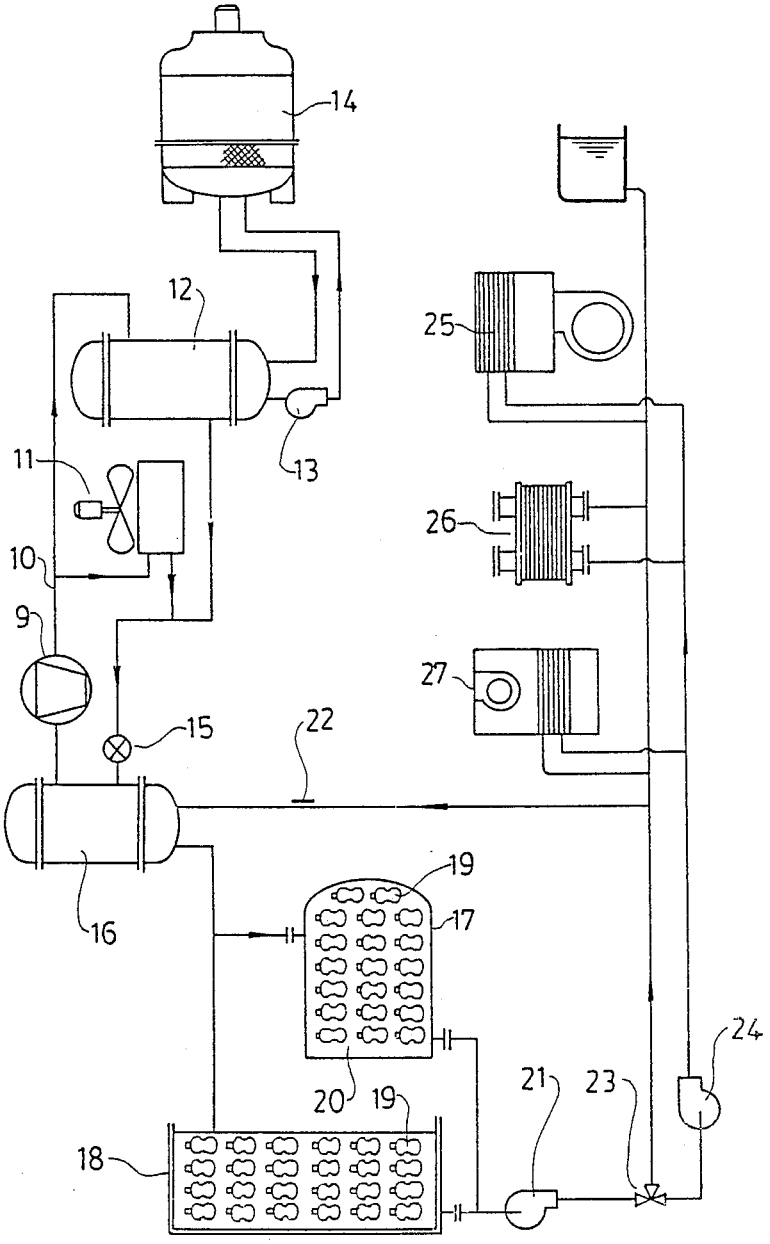
FIG. 2 shows the application of the water-ice container in an ice storage system.

FIG. 2 shows an ice storage system in which a plurality of containers 19 of this invention are used. Vapor refrigerant compresses in a compressor 9 and flows to an air-cooled condenser 11 or a water-cooled condenser 12 through a pipe 10. The water from the water-cooled condenser 12 is forced by a pump 13 into a cooling tower 14 in which heat is removed from the water. The liquefied high-pressure refrigerant from condenser 11 or 12 flows to the evaporator 16 through an expansion device 15. The low-temperature vapor refrigerant from the evaporator 16 then returns to the compressor 9.

The ice storage system is associated with the evaporator 16. Brine water solution 20 is forced by a pump 21 into the evaporator 16 in which the temperature of the solution 20 is lowered. Then, the solution 20 flows into an ice bunker 17 or 18 in which numerous closed water-ice containers 19 are received. That is, the solution 20 will flow over the containers 19.

The solution 20 circulated and flowing over the containers 19 can progressively lower the temperature of the containers 19. When the temperature of the water in the containers 19 lowers to 0° C., the water solidifies. While the water solidifies, the solution 20 enters the ice bunkers 17 and 18 at the temperature of −5° C. and leaves the ice bunkers 17 and 18 at the temperature of −2° C. After the water in the containers 19 has totally solidified, the temperature of the ice continues to lower to −2° C. and the solution 20 leaves the ice bunkers 17 and 18 at a temperature of about −4° C. A temperature sensing apparatus 22 in the ice storage system will be activated to stop the operation of the compressor 9, and pumps 21 and 13, thereby completing the ice charge cycle.

When it is desired to use an air conditioning system which is constructed of a fan coil unit 25, a heat exchanger 26, and an air handling unit 27, the ice storage system is brought into an ice discharge cycle. When the operation of the compressor 9, condensers 11 and 12, pump 13, and evaporator 16 stop, a primary pump 21 may be started to pump the solution 20 of −1° C.–3° C. from the ice bunkers 17 and 18 through three-way valve 23 to a secondary pump 24. The solution 20 is then forced by the secondary pump 24 to the fan coil unit 25, a heat exchanger 26, and/or the air handling unit 27 and made to absorb the heat therefrom to raise its temperature to about 10° C.–12° C. The return solution 20 of increased temperature will return to the ice bunkers 17 and 18 through the evaporator 16 so that its temperature will again lower to 1° C.–3° C. Consequently, the solution 20 circulates along the following flow path: from the ice bunkers 17 and 18, to the primary pump 21, to the three-way valve 23, to the secondary pump 24, to the loads 25–27, and then to the evaporator 16. In fact, the temperature of the solution 20 reaching the loads 25–27 can be changed within a range by adjusting the degree of opening the three-way valve 23. It should be understood that the adjustment of the three-way valve 23 permits a selected percent of the return solution 20 of 10° C.–12° C. from the loads 25–27 and the solution 20 of 1° C.–3° C. from the bunkers 17 and 18 to gather together. When the ice in the containers 19 is totally liquefied, the fan coil unit 25, heat exchange 26, and air handling unit 27 cannot be used.

Figure 3:
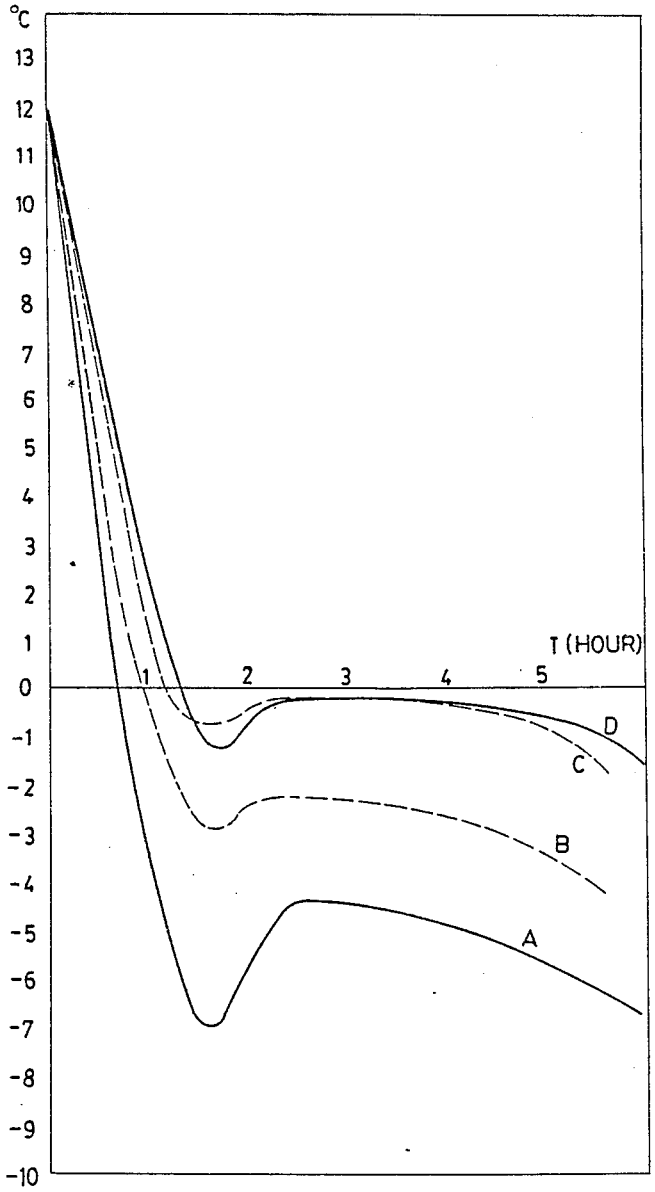
FIG. 3 is a graph illustrating the temperature change of the interior and exterior of a water-ice container in the ice bunker of an ice storage system.

FIG. 3 is a graph illustrating the temperature change of the interior and exterior of a wate-ice container in the ice bunker of an ice storage system in accordance with a test conducted by the inventor. The X-axis of the graph indicates the time of the icing operation, while the Y-axis of the graph indicates the temperature of the water, ice, or the brine water solution. A-curve indicates the temperature change of the solution flowing over the water-ice containers in accordance with prior art. B-curve indicates the temperature change of the water or ice in the water-ice containers in accordance with prior art. C-curve indicates the temperature change of the solution 20 flowing over the containers 19 in accordance with this invention. D-curve indicates the temperature change of the water or ice in the containers 19 in accordance with this invention.

As indicated in the C- and D-curves of FIG. 3, when solution 20 is cooled to a temperature of −3° C., the water in the containers 19 begins to solidify. Subsequently, the water continues to solidify while the temperature of the solution 20 is maintained at −4.2° C. The temperature of the solution 20 is again lowered to −4.2° C. so that the water in the containers 19 can totally solidify.

By comparison, when the water-ice containers of this invention are used in the ice storage system, the operating temperature of the solution is greatly lowered to significantly reduce its operating time, power, and cost.

In addition, because the water-ice container 19 of this invention is a closed variable-volume container, when the water in the container solidifies into ice and increases its volume, the volume of the container also increases so that the life of the container according to this invention is increased.

With this invention thus explained, it is apparent that numerous modifications and variations can be made without departing from the scope and spirit of this invention. It is therefore intended that this invention be limited only as indicated in the appended claims.

I claim:

1. A container comprising:

a container body having a longitudinal axis, said container body being filled with water;

a central stem secured in said container body, said central stem extending generally along the axis of said container body and serving as a core on which ice deposits when the water in the container body is cooled whereby a temperature at which said water begins to solidify is raised; and a plurality of branches extending generally radially outwardly from said central stem in a brush-like manner whereby the water in said container can initially solidify on said branches when said container body is cooled.

2. The container as claimed in claim 1, wherein said container body includes an opening formed in an end thereof, and a plug sealing said opening of said container body, said central stem being secured to an inenr end of said plug and extending toward the other end of said container body.

3. The container as claimed in claim 2, wherein said central stem is made of metal having high heat conductivity.

4. The container as claimed in claim 2, wherein said central stem extends from said plug to a position adjacent to the other end of said container body.

5. The container as claimed in claim 1, wherein said container body is elongated and has an annular groove in its middle portion so that water can rapidly solidify into ice in said container body.

6. The container as claimed in claim 1, wherein said container body has at least one bellows-like portion which can extend and retract, whereby, said container body is of a variable-volume.

7. The container as claimed in claim 1, wherein said container is used in an ice bunker for an ice storage air conditioning system and said container body contains one of ice, water and a combination of ice and water, said container further including a plug for sealing said container body.

8. The container as claimed in claim 1, wherein said branches are rod shaped and extend at a nonperpendicular angle from said central stem.

9. The container as claimed in claim 7 wherein said rod shaped branches are solid.

10. The container as claimed in claim 1, wherein said central stem is sealed whereby water fails to flow therethrough during use.

11. The container as claimed in claim 1, wherein said central stem is solid whereby water fails to flow therethrough during use.

12. The container as claimed in claim 2, wherein said plug seals said container body during use such that the water is held therein.

* * * * *